US007143453B2

(12) United States Patent
Duran

(10) Patent No.: US 7,143,453 B2
(45) **Date of Patent: *Dec. 5, 2006**

(54) REINFORCED UNDERGARMENT

(75) Inventor: Stella Duran, Pembroke Pines, FL (US)

(73) Assignee: Intermarketing Express, Inc., Coconut Grove, FL (US)

( * ) Notice: Subject to any disclaimer, the term of this patent is extended or adjusted under 35 U.S.C. 154(b) by 647 days.

This patent is subject to a terminal disclaimer.

(21) Appl. No.: 10/190,301

(22) Filed: Jul. 5, 2002

(65) Prior Publication Data

US 2003/0019014 A1 Jan. 30, 2003

Related U.S. Application Data

(63) Continuation of application No. 09/749,250, filed on Dec. 27, 2000, now Pat. No. 6,430,753.

(60) Provisional application No. 60/173,879, filed on Dec. 30, 1999.

(51) Int. Cl.
*A41B 11/02* (2006.01)
*A41C 1/00* (2006.01)

(52) U.S. Cl. ..... 2/409; 450/132

(58) Field of Classification Search ..... 2/239, 2/240, 241, 242, 409, 400–407, 227, 228; 450/95, 104, 111, 131, 132, 100, 106, 155, 450/107, 123

See application file for complete search history.

(56) References Cited

U.S. PATENT DOCUMENTS 2,668,953 A * 2/1954 Tofanelli ..... 450/99
2,928,397 A * 3/1960 Pucci ..... 450/99
3,068,871 A * 12/1962 Rapp ..... 450/95
3,131,698 A * 5/1964 Morano ..... 450/99
3,375,829 A * 4/1968 Brennan et al. ..... 450/115
3,513,853 A * 5/1970 Marino ..... 450/104
4,325,379 A * 4/1982 Ozbey ..... 450/116
D309,820 S * 8/1990 Bryant ..... D2/712
5,201,074 A * 4/1993 Dicker ..... 2/70
5,590,548 A * 1/1997 Osborne ..... 66/177
5,888,118 A * 3/1999 Kishi ..... 450/122
6,430,753 B1 * 8/2002 Duran ..... 2/239
6,463,765 B1 * 10/2002 Blakely ..... 66/178 R

* cited by examiner

*Primary Examiner*—Alissa L. Hoey
(74) *Attorney, Agent, or Firm*—Malloy & Malloy, P.A.

(57) ABSTRACT

A reinforced undergarment at least including underpants and, in certain embodiments, a pair of hose or stockings permanently or removably secured to the underpants so as to define a pair of pantyhose, wherein the undergarment, and particularly the underpants are formed from a flexible material including a plurality of interconnected portions disposed and configured to overly predetermined areas of the wearer's body so as to exert a supporting and/or retaining force thereon and thereby shape the wearer's body, or at least certain portions thereof, into a desired configuration. The interconnected portions of the undergarment are at least partially formed from an elastic material of varying densities such that different support and/or retaining force are exerted on predetermined portions of the wearer's body. The underpants include at least a first support portion and a second support portion, wherein the first support portion is disposed beneath the buttocks of the wearer and has a sufficient density to exert an uplifting force thereon. The second support portion includes a reinforced panel of predetermined density disposed in overlying, retaining relation to the wearer's abdomen so as to exert an inwardly directed, retaining force thereon. The various embodiments of the undergarment may include additional support portions disposed in overlying, retaining relation to other predetermined portions of the wearer's body.

6 Claims, 2 Drawing Sheets

REINFORCED UNDERGARMENT

CLAIM OF PRIORITY

This application is a continuation of and a claim of priority is made to patent application having Ser. No. 09/749,250 which was filed in the U.S. Patent and Trademark Office (PTO) on Dec. 27, 2000, now having matured into U.S. Pat. No. 6,430,753 which application was based on and claims priority under 35 U.S.C. Section 119 (e) to an earlier provisional patent application filed in the U.S. PTO on Dec. 30, 1999 and having Ser. No. 60/173,879, all of which are incorporated herein in their entireties by reference.

BACKGROUND OF THE INVENTION

1. Field of the Invention

The present invention is directed towards a reinforced undergarment designed to support and shape predetermined portions of the wearer's body. In one embodiment, the invention may comprise at least a pair of underpants, but in other preferred embodiments, the invention is in the nature of a pair of underpants in combination with a pair of either integrally formed or attached stockings, such that the undergarment comprises a pair of reinforced pantyhose. In either embodiment, the undergarment is formed of an at least partially elastic material of varying densities and includes a plurality of support portions which are specifically structured and disposed to exert retaining and/or supportive forces on various parts of a wearer's body, including the buttocks, abdomen, waist, and upper thigh regions.

2. Description of the Related Art

The wearing of undergarments, whether simple underpants or more elaborate girdles designed to aid a person in the support and retention of certain body parts, is a well known and accepted practice. This practice is supported in great part due to the fact that the fashion trends in modern day society, which include the last several decades as well, have placed heavy pressure on women, almost exclusively, to have a slim and trim figure that can be likened to an hour-glass. However, there are a number of reasons, some of which people cannot control, for the failure of many women to achieve the slender and perfect figure which modern day society exalts. Some of the reasons for the variance in the shape of people's bodies include aging, child birth, over eating, lack of exercise, as well as certain distinct body characteristics and/or physical tendencies, any or all of which can serve to limit people's potential for obtaining the current trend and preference for a slender body. In addition, even those people who are fortunate enough to have a body type which meets the current fashions, meaning a body which is generally tall, slender, etc., have relatively few years in their life span during which the aforementioned preferred body shape or configuration "naturally" occurs. This is the period of a person's life, particularly women, when a slim attractive figure is less difficult to maintain, in terms of diet, exercise, etc. and is normally considered to exist during the late teens and the early twenties and/or those years of the person's life that may generally be referred to as young adulthood.

Accordingly, many people, if not a majority of people in today's society, require some sort of help in terms of trying to obtain an improved figure or body shape. Even some persons who are diligent in performing exercise and/or in following a healthy, low fat, reduced calorie diet may require some sort of help in achieving this goal. For example, as the body ages or upon the occurrence of events such as child birth, exercise and dietary restrictions are frequently not adequate, in and of themselves, to maintain a person's slender, well shaped figure.

In years past, foundation garments such as girdles were used by women, and occasionally men, in the effort to project a slimmer, more acceptable figure, particularly in the area of the waist, abdomen, buttocks, etc. However, the conventional structure and design of such foundation garments involve the use of extremely dense elastic or other wearable material to surround and tightly retain the waist, abdomen and/or buttocks area of a wearer. The extended use of such girdles and similar foundation garments often result in the wearer becoming uncomfortable, at best, and in some instances, can be potentially harmful due to a reduction in circulation or blood flow to some of the areas of the body surrounded by such girdles. In addition, such conventional foundation garments also frequently included semi-rigid stays or similar reinforcing components, strategically located so as to further retain and/or constrict predetermined parts of the body, which may have more of a tendency to protrude or which were abnormally enlarged, such as is prevalent in people who are overweight. Discomfort associated with wearing such components is well known.

Because of these problems and other disadvantages associated with known foundation garments designed to aid in the shaping or support of certain portions of a wearer's body, there remains a long felt need in the garment industry for an improved, reinforced undergarment. If any such improved undergarment were developed, it would preferably be reinforced or otherwise structured and designed to support and shape at least some parts of a wearer's body which are commonly identified as "problem" areas, such as but not limited to a "pot-belly" or the "saddle-bags" that many women have on their thighs just below the buttocks. In addition, any such improved undergarment would preferably also be reinforced or otherwise structured and designed to aid a person with at least temporarily improving her or his figure in a manner which is comfortable and which allows one to wear such reinforced undergarments for an extended amount of time. If any such improved undergarment were developed, it would preferably include at least an undergarment portion in the nature of a pair of underpants, although ideally, it would also comprise a pair of stockings or hose as well, which could either be permanently or removably secured to the underpants, so as to substantially define the undergarment as a pair of pantyhose. Although any such improved undergarment could have a variety of embodiments, it would preferably be at least partially formed from an elastic, flexible material, wherein at least the underpants portion is structured to include a plurality of interconnected support portions of varying densities which are configured to overlie predetermined parts of a wearer's body so as to support and otherwise retain and/or uplift the various, predetermined portions of the wearer's body, and thereby, to collectively aid the body in assuming a preferred shape or configuration, without being uncomfortable or otherwise derogatorily affecting the wearer.

SUMMARY OF THE INVENTION

The present invention is intended to address these and other needs which remain in the art and relates to an improved undergarment. The undergarment of the present invention comprises in one embodiment, at least a pair of underpants, and in more preferred embodiments, a combination of underpants and fixedly attached or integrally formed stockings or hose, such that the undergarment assumes the form of a pair of "pantyhose". Regardless of the embodiment, the undergarment of the present invention is specifically designed and structured to support and shape predetermined parts of the wearer's body so as to provide an overall improved "figure" through the exertion of retaining and supporting forces on the wearer's body.

More specifically, the undergarment of the present invention is structurally reinforced such that at least the underpants are formed from an elastic, flexible material including a plurality of interconnected support portions which may vary relative to one another in density. For purposes of clarity, the term "density", as used herein when referring to the various support portions of the undergarment structure, refers to the density of the weave of threads utilized in the formation of the undergarment. Specifically, the term "Dernier" is used in this art as being representative of the "weave count", wherein the higher the weave count number, the denser the material. Accordingly greater reinforcement or support forces may be exerted on the parts of the body which are contacted by support portions of the undergarment, which are more dense and thereby have a higher Dernier or weave count. By way of example, the material from which the undergarment of the present invention is formed preferably includes a combination of Lycra™ and Poliamide™. One preferred percentage of such a combined composition would be Lycra comprising substantially 34% and Poliamide comprising substantially 66%. Naturally, other percentages of the combination of materials, as set forth above, could be utilized, as well as a variety of different materials other than those indicated. Further, with regard to the density of the material from which the various portions of the undergarment are formed, a representative range of the Dernier or weave count would be from substantially 40, representing the least dense components of the undergarment, to a Dernier of substantially 70, representing the more dense portions of the undergarment of the present invention.

More specifically, the structural features of the present invention include the underpants having an open upper end defining a waist portion and in certain embodiments including a waist band disposed in surrounding relation to the open upper end. When utilized, the waist band has a somewhat enlarged width and is formed from an elastic material of sufficient density to exert a retaining, supportive force about the waist, thereby providing the waist of the wearer with a slimmer appearance. The opposite end of the underpants terminate into conventionally disposed leg openings, which encircle opposite legs of the wearer about the respective thigh area. As set forth above, the undergarment of the present invention may be in the form of a pantyhose wherein, the underpants are permanently secured to the upper end of a pair of stockings or hose. Also, in the various embodiments of the present invention, the stockings may extend along the full length of the leg of the wearer and include feet and ankle enclosing portions, integrally secured to the lower end of the hose. Alternatively, the stockings may include open lower ends and may extend along only a portion of the length of the legs, such as above the knee or to a mid-calf location. The stockings are also formed from an elastic material preferably having a Dernier of 40, wherein the material from which the stockings are formed have sufficient density to at least exert a graduated support on the legs extending along their entire length, from the ankle towards the thigh of the wearer. The support of the legs in this manner thereby adds to the total leg comfort and facilitates extended wear of the undergarment of the present invention.

The underpants are dimensioned and configured to extend over at least a majority of those portions of the lower torso of the wearer wherein shaping and support are typically most needed and preferred. Accordingly, the plurality of interconnected support portions include at least a first support portion extending at least partially beneath the buttocks of the wearer. Further, the first support portion includes at least two elongated segments, wherein each segment includes a somewhat curvilinear configuration extending generally from the crotch outwardly and upwardly, such that each buttock is separately supported by a different one of the segments. The first support portion is formed from a material that has a first density, which is sufficient to exert a supportive, uplifting force on the buttocks. Each of the segments, extend outwardly from a respective or corresponding buttock, towards the waist portion of the underpants and in overlying relation to a separate hip area on different sides of the wearer. Due to the intended uplifting, supportive force exerted by the first support portion, it is formed of a material preferably having a Dernier or weave count of substantially 70, which is greater than the densities of at least the majority of remainder of the support portions incorporated in the underpants.

The underpants further includes a second support portion in the form of a panel disposed in overlying relation to the abdominal area of the wearer. This second support portion has a sufficient density to exert an inwardly directed force against the abdomen so as to prevent or significantly reduce any protrusion or outwardly extending bulge of the abdomen. The disposition and structure of the abdominal panel of the second support portion thereby projects a slimmer configuration, particularly in the area of the abdomen or lower stomach of the wearer. Further, the density of the second support portion may of course vary but, in at least one embodiment has a substantially equal density as that of the first support portion.

A third and fourth support portions are adjacently positioned in overlying, surrounding relation to different parts of the wearer's thigh. More specifically, the third support portion includes a material formed of somewhat lesser density than that of the first and second support portions and is disposed adjacent to and somewhat below the elongated segments of the first support portion which are disposed in supporting, uplifting relation to the buttocks of the wearer. This third support portion could be more generally defined as a "modeling" band disposed, dimensioned and configured to slim the hip and thighs of the wearer and depending upon the embodiment, may extend above the thigh area, upwardly to a position somewhat adjacent to a mid or upper portion of the elongated segments, defining the first support portion.

The aforementioned fourth support portion includes two substantially annular bands disposed in encircling relation to different thighs of the wearer and are more specifically disposed substantially at the junction between the upper ends of the stockings or hose and the lower, leg openings of the underpants. The density of the fourth support portion is somewhat greater than that of the third support portion and, in certain embodiments, may have a density substantially equal to that of the first and second support portions. The encircling bands defining the fourth support portion are disposed, configured, and structured to exert a medium, supportive and retaining force or pressure on the wearer's body, so as to eliminate bulges commonly occurring about the upper thighs of the wearer.

One or more additional support portions may be formed on the underpants and disposed and configured to contact or specifically overly predetermined areas of the lower torso of the wearer's body so as to exert a retaining force thereon and thereby further add to the shaping characteristics of the reinforced undergarment of the present invention.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
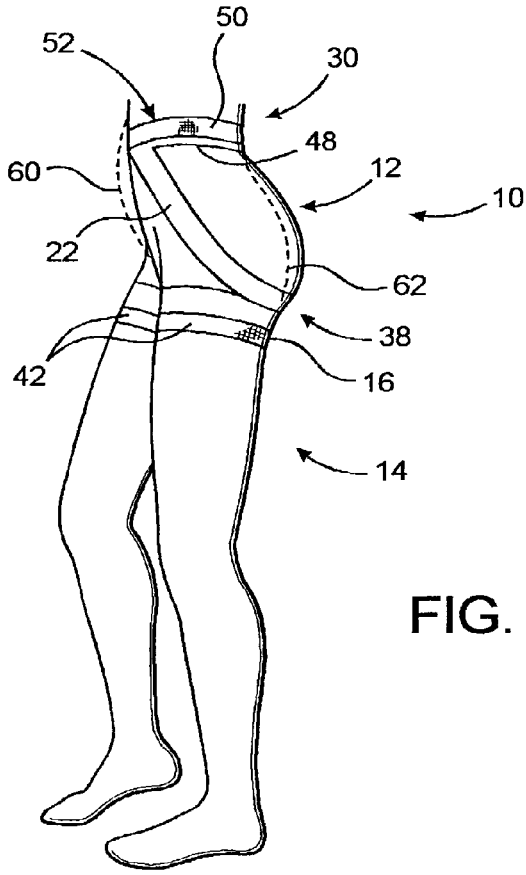
FIG. 1 is a perspective view in partial cutaway of the undergarment of the present invention in the form of pantyhose.

The present invention is directed towards an undergarment generally indicated as 10 in the accompanying Figures and designed and structured to both support and shape certain parts of a wearer's body in order to give the appearance of a slimmer, shapelier configuration. More specifically, the undergarment 10 includes at least a pair of underpants, generally indicated as 12 and in certain embodiments as shown in FIG. 1, a pair of stockings or hose 14. The stockings 14 may be permanently or removably attached to the underpants 12 at a junction 16, which generally coincides with the leg openings 18 of the underpants 12. Naturally, when the stockings 14 are secured to the underpants 12, the undergarment 10 defines what is typically known as "pantyhose". However, it is again emphasized that the underpants 12 can be used without the hose or stockings 14 being attached thereto, wherein both embodiments are intended to be included within the spirit and scope of the present invention.

Figure 2:
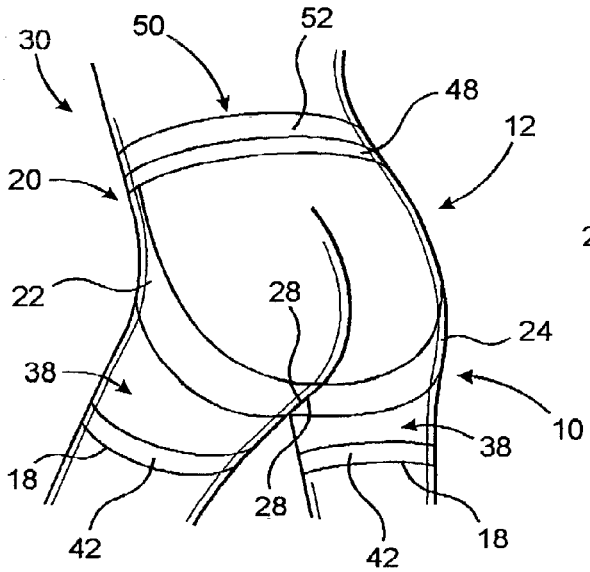
FIG. 2 is rear perspective view of another embodiment of the present invention in the form of underpants.

In either embodiment, the underpants 12 are formed from an elastic material and comprise a plurality of interconnected support portions which preferably have varying densities, so as to provide varying amounts of support to the various parts of the wearer's body, which the plurality of support portions contact or overlie. More specifically, the underpants 12 include a first support portion 20 formed of a material preferably having first predetermined density, which is equal to or greater than the majority of the remainder of the plurality of support portions forming the underpants, as will be explained in greater detail hereinafter. The first support portion 20 is disposed to extend substantially below and in supporting relation to the buttocks of the wearer as clearly shown in FIGS. 1, 2 and 5. More specifically, the first support portion 20 comprises two elongated segments 22 and 24 each having a proximal end 26 and a distal end 28. As shown, each proximal end 26 of the elongated segments 22 and 24 terminates substantially adjacent to a waist portion, generally indicated as 30 and wherein the distal end 28 of each of the elongated segments 22 and 24 terminate generally between the legs of the wearer and substantially at the crotch area 31. As best shown in FIGS. 1 and 2, the elongated segments 22 and 24 may assume somewhat a curvilinear configuration as each of the segments 22 and 24 extend beneath and in somewhat uplifting relation to each buttock of the wearer.

Figure 5:
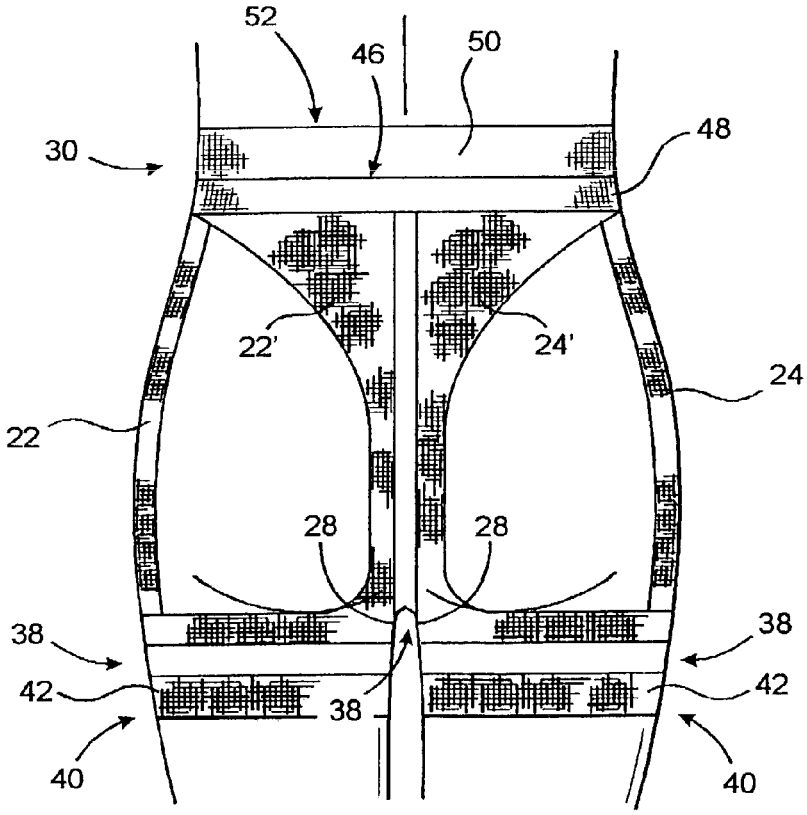
FIG. 5 is a rear view in partial cutaway of the embodiment of FIG. 4.

In the embodiment shown in FIG. 5, the first support portion 20 may also include inner segments 22' and 24', which rise up from the distal ends 28 of each segment 22 and 24, between the respective buttocks. Accordingly, the elongated segments 22 and 24 are cooperatively disposed and structured with extensions 22' and 24' to at least partially surround corresponding ones of the buttocks, so as to further facilitate the exertion of a retaining, supportive, uplifting force thereon. As set forth above the density, of the first support portion 20 and more specifically each of the elongated segments 22 and 24, as well as the segment extensions 22' and 24' are formed preferably from a material having a first predetermined density which is equal to or greater than at least a majority of the densities of the other of the plurality of support portions of the underpants. While this first density of the first support portion 20 may vary, it preferably comprises a Dernier of substantially 70.

Figure 3:
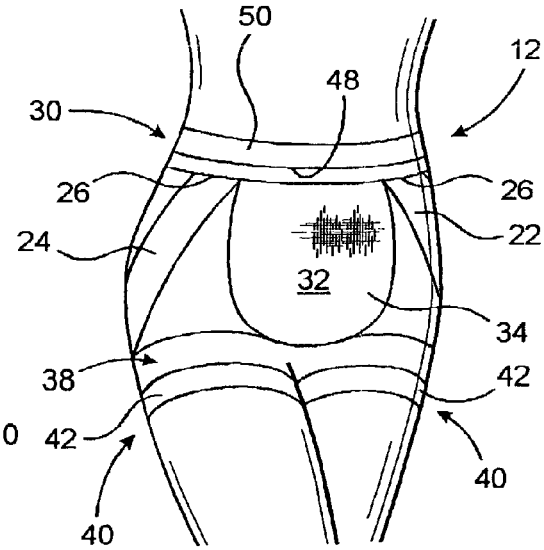
FIG. 3 is a front perspective view of the embodiment of FIG. 2.
Figure 4:
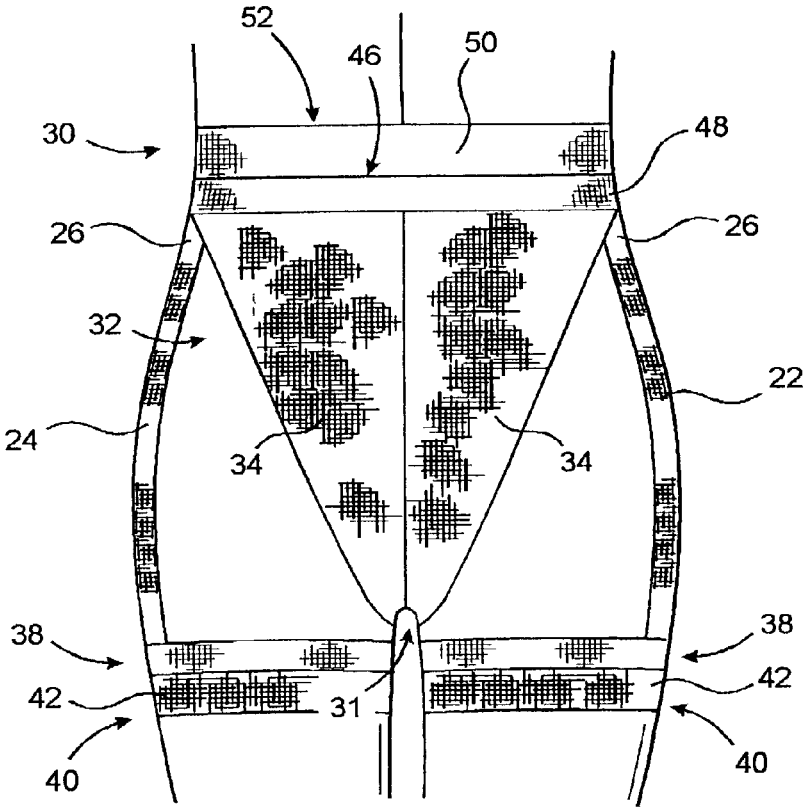
FIG. 4 is a front view in partial cutaway of another embodiment of the undergarment of the present invention.

The underpants 12 also includes a second support portion 32 as best shown in FIGS. 3 and 4. The second support portion 32 comprises a panel 34, formed of an elastic material having a predetermined second density, wherein the panel 34 of the second support portion 32, is disposed in overlying, supporting and retaining relation to the abdomen or stomach area as clearly demonstrated. The panel 34 generally extends from a position adjacent the waist 30 of the underpants 12, downwardly into somewhat of a triangular or rounded configuration, as shown in the different embodiments of FIGS. 3 and 4, and towards and in connection with the crotch area 31. The second support portion 32, comprising the panel 34 is formed of a material having a predetermined second density which may vary, but which preferably has a density substantially equal to the first support portion 20, wherein the second predetermined density also has a Dernier or weave count of substantially 70.

The underpants 12 of the undergarment 10 of the present invention further comprises a third support portion generally indicated as 38, which in the various embodiments of accompanying Figures is formed from an elastic material having a third predetermined density which defines a "modeling" band extending about the upper thigh areas. The third predetermined density of the third support portion 38 is sufficient to exert a supportive, inwardly directed and at least partially retaining force on the upper thigh portions of the wearer, thereby serving to reduce or eliminate bulges or other protruding areas frequently occurring at such locations on a wearer's body. The third predetermined density may vary, but in the embodiment shown preferably comprises a Dernier or weave count less than 70 but greater than 40.

The plurality of interconnected, elastic material support portion which define the underpants 12, further comprise a fourth support portion generally indicated as 40 and including two circular or similarly configured bands 42, each of which are disposed in surrounding relation to a portion of a different of the wearer. Each of the circular bands 42 are spaced apart from one another and extend in spaced relation to the elongated segments 22 and 24, defining the first support portion. Further, each of the bands 42 of the fourth support portion 40 may be disposed adjacent to or contiguous with the third support portion 38, defined by the aforementioned modeling band. Further, each of the bands 42 of the fourth support portion 40 are disposed substantially at the junction of the upper end of the stockings or hose 14, as at 16 and the leg openings of the underpants 12, as at 18. The latter structure is of course utilized when the undergarment 10 is in the form of pantyhose as demonstrated in FIG. 1. However, the underpants 12 may still include the fourth support portion 40, including the circular bands 42 disposed in overlying supportive relation to a portion of the thighs of the wearer, when the underpants 12 are used alone, without the hose or stockings 14.

The undergarment 10 further includes a fifth support portion, generally indicated as 46 and formed on the underpants 12. The fifth support portion 46 comprises a medium compression band 48 disposed in overlying, at least partially surrounding relation to a portion of the waist of the wearer. Further, the fifth support portion 46 is formed of a predetermined fifth density which is sufficient to exert inwardly directed, supportive and retaining forces about the corresponding portion of the waist of the wearer. The predetermined fifth density is preferably somewhat less than the predetermined first and second densities of the first and second support portions 20 and 32 respectively and preferably has a Dernier of somewhat less than 70 but somewhat greater than 40. The band 48 is also disposed in immediately adjacent relation to a waist band 50 which may define and surround the periphery of the open upper end of the underpants 12, generally indicated as 52. As shown in the accompanying Figures, the waist band 50, as well as the band 48 defining the fifth support portion 46 may collectively or individually define the waist of undergarment 12, generally indicated as 30, and may collectively serve to contain the open upper end 52 of the underpants 12 in secured engagement about the waist of the wearer, as well as provide the aforementioned retaining and supportive forces.

Therefore, as shown in FIG. 1, the plurality of support portions, as set forth above, are disposed in overlying, contacting relation to various, predetermined parts of the wearer's body so as to project a somewhat slimmer, more compact and desirable shape or configuration of the lower torso of the wearer's body by retaining certain portions thereof inwardly from what may be considered a normal shape as indicated by the phantom lines 60 and 62.

In addition, when the undergarment 10 is in the form of pantyhose the stockings or hose 14 may extend along the full length of the leg as shown in FIG. 1 and/or only a portion thereof, dependent upon the style of the stocking preferred by the wearer. Also the stockings or hose 14 are formed from an elastic material having a predetermined density sufficient to provide a graduated support along the length of the leg, thereby facilitating total leg comfort. The preferred Dernier or weave count of the stockings 14 is preferably in the range of substantially 40.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described.

What is claimed is:

1. A reinforced undergarment designed to support and shape a wearer's body, said undergarment comprising:

a) underpants including a plurality of interconnected portions, at least some of which are formed from an elastic material, b) said plurality of interconnected portions including a first support portion extending at least partially beneath and in supporting relation to the buttocks of the wearer, c) said first support portion having a predetermined first density substantially equal to or greater than the density of at least a majority of a remainder of said plurality of interconnected portions, said first density being at least sufficient to exert an uplifting force on the buttocks of the wearer, d) said plurality of interconnected portions further including a second support portion disposed in overlying relation to the wearer's abdomen, e) said second support portion comprising a predetermined second density being at least sufficient to exert a substantially inwardly directed support force on the wearer's abdomen, f) said first support portion comprising two elongated segments disposed in spaced apart relation to one another, each of said two segments disposed below and in supporting relation to a different buttock of the wearer, and g) said plurality of interconnected portions further including a third support portion at least partially disposed adjacent said first support portion below each of said two elongated segments and the wearer's buttocks.

2. An undergarment as recited in claim 1 wherein said third support portion is disposed in overlying, substantially covering relation to at least the wearer's upper thighs and comprises a predetermined third density being at least sufficient to exert a substantially inwardly directed retaining force on the wearer's thighs.

3. An undergarment as recited in claim 2 wherein said third density is less than said first density.

4. An undergarment as recited in claim 1 further comprising a pair of stockings secured to said underpants and extending outwardly therefrom in covering relation to the wearer's legs, said underpants and said stockings collectively structured to at least partially define a pair of pantyhose.

5. An undergarment as recited in claim 4 wherein said plurality of interconnected portions further comprise a fourth support portion formed at a junction of said pair of stockings and said underpants and in substantially surrounding relation to each thigh of the wearer.

6. An undergarment as recited in claim 5 wherein said fourth support portion comprises a predetermined fourth density being at least sufficient to exert a substantially inwardly directed retaining force on the wearer's thighs.

* * * * *